United States Patent [19]

Spademan

[11] 4,312,517

[45] Jan. 26, 1982

[54] RELEASABLE SKI BINDING WITH SKI BRAKE LOCATING STOP

[76] Inventor: Richard G. Spademan, Box 6410, Incline Village, Nev. 89450

[21] Appl. No.: 121,366

[22] Filed: Feb. 14, 1980

[51] Int. Cl.[3] ..... A63C 7/10

[52] U.S. Cl. ..... 280/605; 280/624

[58] Field of Search ..... 280/605, 624

[56] References Cited

U.S. PATENT DOCUMENTS 4,078,825 3/1978 Riedel ..... 280/605

4,239,254 12/1980 Riedel ..... 280/605

*Primary Examiner*—Robert R. Song

*Attorney, Agent, or Firm*—Townsend and Townsend

[57] ABSTRACT

A releasable ski binding having a boot mounted plate means (1,19) is provided for use with a ski brake (3) having a holding means (2,2') for centering the boot plate (1,19) laterally and longitudinally with respect to clamping members in the binding. In one embodiment the holding means (2) is removably received in a recess (5) in the boot mounted plate (1). In another embodiment the holding means (2') is shaped to enclose the end of a boot mounted plate (19) for centering the boot mounted plate (19).

10 Claims, 4 Drawing Figures

RELEASABLE SKI BINDING WITH SKI BRAKE LOCATING STOP

BACKGROUND OF THE INVENTION

The present invention relates to releasable ski bindings and brakes in general and in particular to a releasable ski binding useable in conjunction with a ski brake for centering a ski boot longitudinally and laterally in the binding.

In applicant's U.S. Pat. No. 3,606,370 issued Sept. 20, 1971 there is disclosed a releasable ski binding having a boot mounted plate means and a clamping means for releasable securing a ski boot to a ski rearward of the toe and forward of the rear of the heel of the ski boot.

In applicant's co-pending application Ser. No. 73,997 filed Sept. 10, 1979 there is disclosed a ski brake having a holding means for holding the ski brake in an inoperative position.

In practice entry into a ski binding as disclosed in U.S. Pat. No. 3,606,370 which is being used with a ski brake as disclosed in applicant's copending application Ser. No. 73,997 is most easily accomplished using the holding means of the ski brake. By stepping downwardly between the side clamping members of the binding with the boot mounted plate means being utilized for engaging the holding means of the ski brake, the position of the ski boot can be fixed longitudinally relative to the clamping members.

While heretofore, the holding means of the ski brake in cooperation with the boot mounted plate means may be employed for facilitating the positioning of the ski boot in the binding longitudinally relative to the clamping members, there has not been heretofore any means provided in either the binding including the boot plate or the holding means of the ski brake in either the above identified patent or application for centering the ski boot laterally between the clamping members. Such a capability is particularly desirable on a steep or icy slope to insure proper engagement of the binding parts.

SUMMARY OF THE INVENTION

In view of the foregoing, a principal object of the present invention is a binding usable in cooperation with a ski brake holding means for centering a ski boot laterally and longitudinally relative to clamping members provided therein.

In one embodiment of the invention there is provided a ski boot mounted plate means comprising a plate member which is provided with a recess for receiving the holding means of the ski brake.

In another embodiment of the invention, wherein a boot mounted plate member as described above is mounted in a cavity in the sole of the ski boot, there is provided a recess in the sole for receiving the holding means of the ski brake for entry of the holding means to the recess provided in the boot mounted plate member.

In still another embodiment of the present invention there is provided a ski brake with a holding means having a recess portion in the holding means with portions of the holding means extending from the lateral edges thereof for capturing the rear of a conventional boot mounted plate member therebetween for centering the ski boot laterally and longitudinally relative to clamping members provided therein.

BRIEF DESCRIPTION OF THE DRAWING

The above and other objects, features and advantages of the present invention will become apparent from the following detailed description of the accompanying drawing in which.

DETAILED DESCRIPTION OF THE INVENTION

Figure 1:
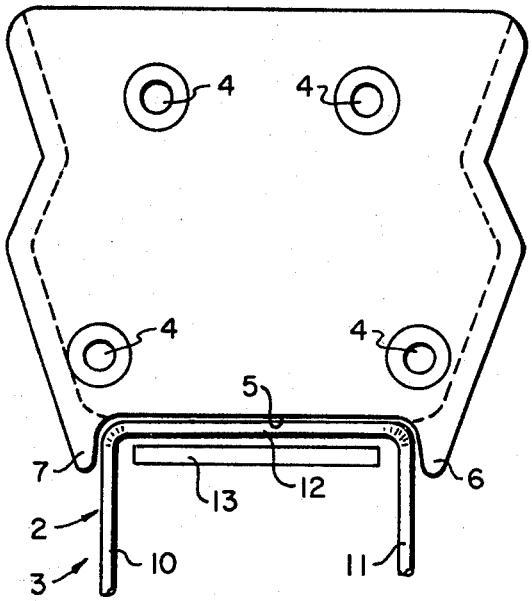
FIG. 1 is a bottom partial plan view of a boot mounted plate member and a ski brake according to the present invention.
Figure 2:
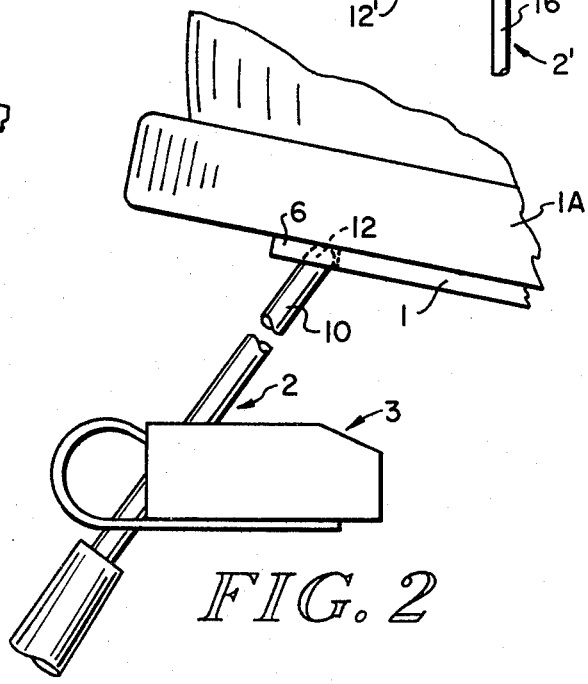
FIG. 2 is a side elevation view of portions of the ski brake and boot mounted plate member of FIG. 1.

Referring to FIGS. 1 and 2 there is provided a boot mounted plate member designated generally as 1 and a holding means designated generally as 2 of a ski brake apparatus designated generally as 3.

In the plate number 1 there is provided a plurality of screw holes 4. The screw holes 4 are provided for mounting the plate 1 to the sole of a ski boot 1A.

In the rear edge of the plate 1 there is provided a recess 5. Extending from the lateral edges of the recess 5 there is provided a pair of rearwardly extending members 6 and 7. Spaced from the rear edge of the plate 1 and forming a wall of the recess 5 there is provided an elongated, generally rectangular member forming a boot locating stop 13. The stop 13 is fitted to the boot sole between and spaced from the members 6 and 7.

The holding means 2 of the ski brake 3 comprises a pair of arm members 10 and 11. The arm members 10 and 11 are connected at one end by a cross member 12. The length of the cross member 12 is such that the cross member 12 fits in the recess 5 between the stop 13 and the boot plate 1 with the arm members 10 and 11 extending rearwardly past the ends of the stop 13 when the boot plate 1 is brought into engagement with the holding means 2, as seen more clearly in FIG. 2.

Figure 3:
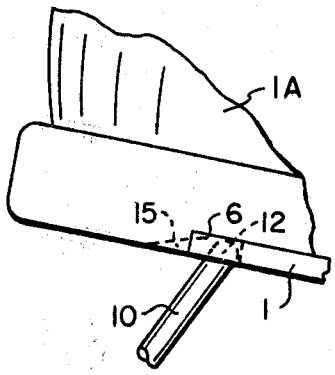
FIG. 3 is a partial side elevation view of an alternative embodiment according to the present invention.

Referring to FIG. 3, in the embodiments wherein the boot mounted plate 1 is inserted in a cavity provided therefor in the sole of the ski boot 1A there is provided in the sole of the ski boot 1A a cavity 15. The cavity 15 is provided for entry of the cross member 12 of the holding means 2 to the recess 5 and the rear edge of the boot mounted plate means 1. The stop 13 may be omitted in this embodiment so that the boot 8 has a smooth uniform bottom.

Figure 4:
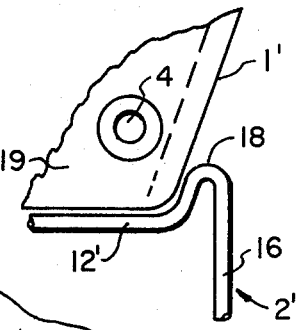
FIG. 4 is a partial bottom plan view of still another embodiment of the present invention.

Referring to FIG. 4, there is provided in still another embodiment of the present invention a modified ski brake holding means designated generally as 2'. In the holding means 2' there is provided a pair of spaced arm members 16, only one of which is shown, corresponding to the arm members 10 and 11 of FIGS. 13. A cross member 12' corresponding to the above described cross member 12 is provided for interconnecting the arm members 16.

The holding means 2' differs from the holding means 2 in that the cross member 12' is recessed from the end 18 of the arm member 16 by a predetermined amount sufficient to capture the rear end of a conventional boot mounted plate member 19 therebetween.

In all other respects the boot mounted plate member 19 and the ski brake having the holding means 2' are identical to and function in the same manner as the boot mounted plate member 1 and the holding means 2 of the ski brake 3 described above with respective FIGS. 1–3.

In use, a skier entering a binding according to the present invention moves the boot 1A over the holding means 2 or 2' of the ski brake 3 until the holding means 2 or 2' is engaged in the recess 5 in the boot mounted plate member 1 or engages the end of the boot mounted plate member 19. Thereafter, downward pressure on the holding means 2 or 2' will terminate in a centering of the ski boot longitudinally and laterally in the binding.

While a preferred embodiment of the present invention is disclosed and a number of alternative embodiments are suggested, it is contemplated that still other modifications will occur to those skilled in the art and may be made thereto without departing from the spirit and scope of the present invention. Accordingly, it is intended that the embodiments described and suggested be employed only for purpose of illustrating the invention and that the scope of the invention be determined solely by reference to the claims hereinafter provided and their equivalents.

What is claimed is:

1. In a releasable ski binding having clamping means for releasably securing a ski boot to a ski, said ski boot having plate means mounted to the boot substantially parallel to the sole thereof, and a ski brake having a holding means for holding said ski brake in an inoperative position, the improvement comprising:

means for centering said ski boot laterally and longitudinally relative to said clamping means, said centering means comprising said holding means and plate means adapted for mutual engagement.

2. An improvement according to claim 1 wherein said centering means comprises a recess in the rear edge of said plate means with means extending rearwardly from each of the lateral edges thereof for receiving said holding means between said rearwardly extending means.

3. An improvement according to claim 2 wherein said plate means is mounted in a cavity provided therefor in the sole of said ski boot and said centering means comprises a recess in said boot sole for entry of said holding means into said recess at the rear edge of said plate means.

4. An improvement according to claim 2 comprising a boot stop located rearwardly of said rear edge of said plate means for stopping the forward movement of a ski boot being moved forwardly over the top of said holding means.

5. The improved ski binding according to claim 1 wherein said plate means includes a transverse edge and forwardly directed lateral edges extending from said transverse edge and said holding means includes a central member configured to engage at least portions of said transverse edge and said lateral edges to center said ski boot laterally and longitudinally.

6. The improved ski binding according to claim 5 wherein said central member comprises a U-shaped wire member having a pair of lateral arm members, a cross member connecting said lateral arm members and edge means comprising an extension of said arm members a predetermined distance beyond said cross member whereby said cross member engages said transverse edge and said edge means engage said lateral edges.

7. A ski binding with clamping means for releasably securing a ski boot to a ski at a location on the boot forward of a heel of the boot and rearward of a toe of the boot, the binding comprising, a plate means for mounting to the boot at said location, a ski brake having a holding means for holding said ski brake in an inoperative position, and means operable in cooperation with said ski brake holding means for centering said ski boot laterally and longitudinally relative to said clamping means, said centering means including a recess in said plate means and means extending rearwardly from each of the lateral edges thereof for receiving said holding means between said rearwardly extending means.

8. An improvement according to claim 7 wherein said plate means is mounted in a cavity provided therefor in the sole of said ski boot and said centering means comprises a recess in said boot sole for entry of said holding means into said recess at the rear edge of said plate means.

9. An improvement according to claim 7 comprising a boot stop located rearwardly of said rear edge of said plate means for stopping the forward movement of a ski boot being moved forwardly over the top of said holding means.

10. Apparatus for use with a ski binding adapted to secure a ski boot to a ski at a location on the boot forward of a heel thereof and rearward of a toe thereof, the apparatus comprising a ski brake adapted to be attached to the ski, holding means which is independent of the ski binding and is engageable by the boot for holding the brake in an operative position, and locating means adapted to be attached to the boot at said location and formed to engage the holding means and determine the relative lateral position of the locating means with respect to the holding means when they are in mutual engagement so that the locating means and the holding means determine the relative lateral position of the boot on the ski when the locating means is attached to the boot and the brake is attached to the ski.

* * * * *